US006966479B2

(12) United States Patent
Tanaka et al.

(10) Patent No.: US 6,966,479 B2
(45) Date of Patent: Nov. 22, 2005

(54) STAPLER

(75) Inventors: Shigekazu Tanaka, Osaka (JP); Katsuaki Furukawa, Osaka (JP); Syuro Osato, Osaka (JP)

(73) Assignee: Kokuyo Co., Ltd., Osaka (JP)

( * ) Notice: Subject to any disclaimer, the term of this patent is extended or adjusted under 35 U.S.C. 154(b) by 0 days.

(21) Appl. No.: 10/257,571

(22) PCT Filed: Mar. 4, 2002

(86) PCT No.: PCT/JP02/01949

§ 371 (c)(1),
(2), (4) Date: Oct. 15, 2002

(87) PCT Pub. No.: WO02/070209

PCT Pub. Date: Sep. 12, 2002

(65) Prior Publication Data

US 2003/0047581 A1 Mar. 13, 2003

(30) Foreign Application Priority Data

Mar. 5, 2001 (JP) ..... 2001-060961

(51) Int. Cl.[7] ..... B25C 5/02

(52) U.S. Cl. ..... 227/144; 227/132; 227/120; 227/127; 227/156; 227/134

(58) Field of Search ..... 227/132, 120, 227/127, 156, 134, 144

(56) References Cited

U.S. PATENT DOCUMENTS

| | | | | |
|---|---|---|---|---|
| 2,859,443 | A * | 11/1958 | Jopp | 227/156 |
| 4,014,493 | A * | 3/1977 | Wolfe | 227/156 |
| 4,040,556 | A * | 8/1977 | Dahle | 227/120 |
| 4,243,168 | A * | 1/1981 | Balma | 227/123 |
| 4,288,019 | A * | 9/1981 | Dahle | 227/156 |
| 4,981,245 | A * | 1/1991 | Sato | 227/156 |
| 6,152,347 | A * | 11/2000 | Wilson et al. | 227/134 |
| 6,550,661 | B2 * | 4/2003 | Aoki | 227/134 |

FOREIGN PATENT DOCUMENTS

| | | |
|---|---|---|
| JP | 62-282877 | 12/1987 |
| JP | 11-188658 | 7/1999 |

* cited by examiner

*Primary Examiner*—John Sipos
*Assistant Examiner*—Michelle Lopez
(74) *Attorney, Agent, or Firm*—Lowe Hauptman & Berner, LLP

(57) ABSTRACT

A stapler 10 has a stapler main body 11 made of metal and a cover 12 made of resin. The cover 12 has an upper cover 55, which is positioned at the handle 19 side of the stapler main body 11, and a base cover 56, which is pivotally connected to the upper cover and is positioned at the base 21 side of the stapler main body 11.

20 Claims, 19 Drawing Sheets

STAPLER

TECHNICAL FIELD

The present invention relates to a stapler, and more particularly, to a stapler that is capable of, when a stapler main body and cover are made of different materials respectively, fractionating from each other and is further capable of achieving a reduction of operation force utilizing the cover.

BACKGROUND ART

Conventionally, as a simple binding apparatus, a stapler is widely used. As a stapler of this kind, generally, a stapler, which comprises a stapler main body made of metal provided with a frame for storing staples, a handle having a pusher blade for impelling a staple, and a base having an anvil for clinching the staple, which is mounted rotatably with respect to these frame and handle, and an upper cover and a base cover made of resin, which cover the outside of the handle and base respectively, is used.

However, in the stapler of this kind, since the upper cover and the base cover are fixed to the stapler main body, when disposing of the same, such an inconvenience is caused that the upper cover and the base cover can not be separated from the stapler main body.

Accordingly, a stapler, in which the upper cover and the base cover are mounted detachably to the corresponding handle and the base to allow the stapler main body to be fractionated therefrom, has been proposed.

However, since the stapler is constituted so that each of the upper cover and the base cover is mounted separately to the handle and the base, mounting work and dismounting work thereof are required respectively. That is to say, the respective works for mounting and dismounting are required to carry out twice respectively. Further, when the stapler is dropped on a floor or the like, such an inconvenience that the cover is removed accidentally from the stapler main body is apt to happen by the shock.

DISCLOSURE OF INVENTION

The present invention has been devised considering these inconveniences as described above, and an object thereof is to provide a stapler in which the stapler main body and the cover can be assembled and disassembled easily, and prevent the cover from being separated therefrom accidentally.

Another object of the present invention is to provide a stapler capable of reducing the operation force for impelling a staple utilizing the cover.

In order to achieve the above-described objects, the present invention adopts such structure that a stapler comprises a stapler main body provided with a frame adapted to be capable of storing staples and impelling a staple from an ejecting section at the front end thereof, a handle provided with a pusher blade for impelling the staple, and a base mounted to these frame and handle to be capable of performing relative rotation with respect thereto and having an anvil for clinching an impelled staple, a cover mounted to the stapler main body so as to cover the outside thereof; wherein the cover is comprised of an upper cover positioned at the handle side, and a base cover positioned at the base side and connected with the upper cover so as to perform relative rotation, and the stapler main body is mounted detachably to the cover; or, the stapler main body is mounted detachably to the cover without releasing the state of connection between the upper cover and base cover; or, the stapler main body is mounted to these covers detachably by rotating the same with respect the cover in a state that the same is positioned between the upper cover and base cover. When a structure as describe above is adopted, since it is not necessary to mount the upper cover and the base cover separately to the handle and the base of the stapler main body, the cover can be mounted thereto extremely easily and swiftly. Further, since the upper cover and the base cover are integrated with each other, even when the stapler is dropped on a floor or the like, it is possible to prevent the cover from being dismounted therefrom accidentally. Particularly, in such a structure that the above-described mounting/dismounting is made by a relative rotation of the stapler main body and the cover, it is possible to reliably prevent the stapler main body and the cover from being separated from each other unless an artificial work is applied thereto.

It is preferred to adopt such a structure that the upper cover according to the invention is provided with an upper wall at the upper face side of the handle, and side walls continuing to the upper wall, and in the rear-inner face side of the respective side walls, a bearing groove capable of receiving a rotation shaft of the stapler main body from the direction along the face of the side wall is formed respectively. Owing to this, the rotation shaft of the stapler main body can be positioned at the inner face sides of the side walls without overburden and smoothly, which makes it possible, by extension, to perform cover mounting operation to the stapler main body easily and swiftly.

Further, such a structure that the upper cover is provided with an upper wall at the upper face side of the handle, and side walls continuing to the upper wall, and the side wall is formed with hooking sections for separating the front end side of the handle forcibly from the front end side of the frame may be adopted. According to the structure as described above, when the front end of the upper cover is rotated largely in the direction of separation with respect to the front end side of the base cover, since it becomes possible to form a large space between the handle and the frame, staples can be loaded easily.

Furthermore, it is preferred to form holding sections on the base cover for engaging with the side edges of the base. Owing to this, the base can be held without becoming unstable in the direction of being lifted up with respect to the base cover.

Still further, it is preferable to form convex portions on the base cover that can engage with the face of the base. When the structure as described-above is adopted, it is possible to hold the base so as not to move in the direction of the face thereof, which makes it possible, acting in combination with the holding sections, to further stabilize the mounting position of the base.

Still furthermore, such a structure may be adopted that, between the upper cover and base cover, a cam mechanism for displacing the upper cover to a recessed position with respect to the base cover when the front end side of these covers is opened largely is provided. According to the structure as described above, even when the remover is extended from the rear end of the stapler main body, the upper cover can be operated to rotate without causing any positional interference between the upper wall rear end of the upper cover and the remover. Accordingly, it is not necessary to form a large space in the rear area of the upper cover, and it also contributes to reduction of the size thereof.

Still further again, a structure, in which the upper cover and base cover are connected to each other to be capable of performing relative rotation at a point in front of the center of relative rotation of the handle and base, and the upper cover is provided with a pressing section that gives an operation force to the handle at a point in front of the center position of relative rotation of the upper cover and base cover, is adopted. When the structure as described above is adopted, it is possible to press the handle with a small operation force utilizing the upper cover effectively.

Incidentally, it is preferable to form the front end of the upper cover at a length so that the same extends largely exceeding the front end of the handle; owing to this, it is possible to further reduce the operation force.

In this description, if not otherwise defined, the word "front" or "front edge" means the left side in FIG. 1; and the word "rear" means the right side in FIG. 1. Also, the words "upper" and "lower" are used based on FIG. 1 as a reference.

BEST MODE FOR CARRYING OUT THE INVENTION

Hereinafter, embodiments of the present invention will be described with reference to the drawings.

Figure 1:
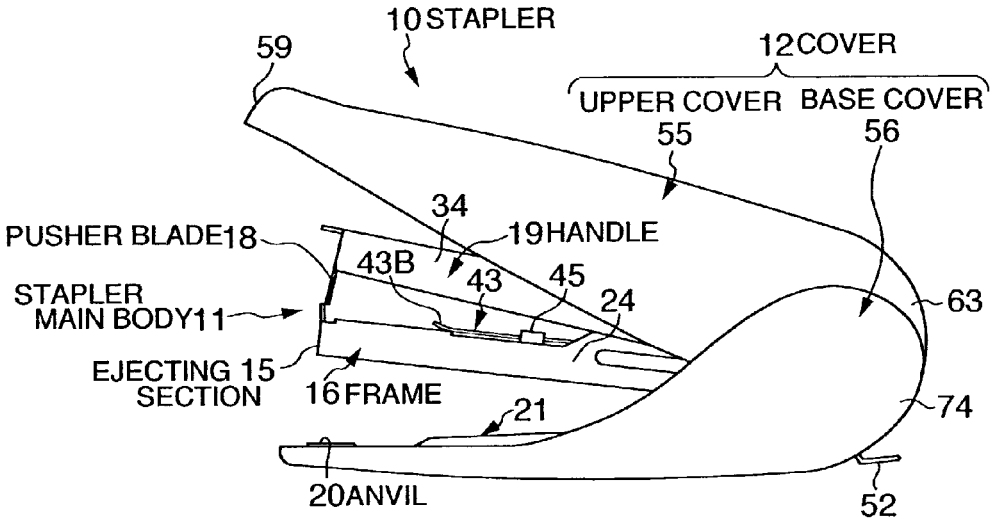
FIG. 1 is a side view of a stapler according to the embodiment.

A schematic side view illustrating the entire structure of a stapler according to the present embodiment is shown in FIG. 1. In this figure, a stapler 10 is comprised of a stapler main body 11 made of metal and covers 12 made of resin mounted on the stapler main body 11 so as to cover the outer side thereof.

Figure 2:
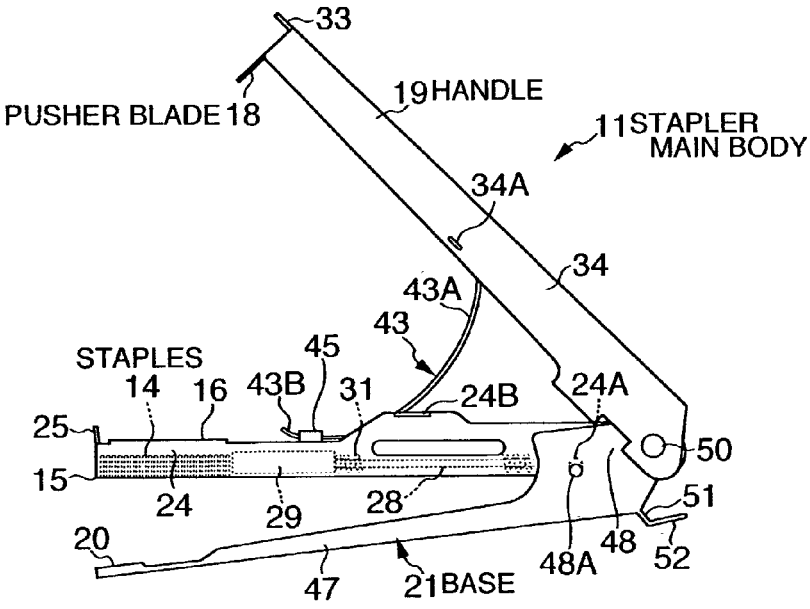
FIG. 2 is a side view of a stapler main body.
Figure 3:
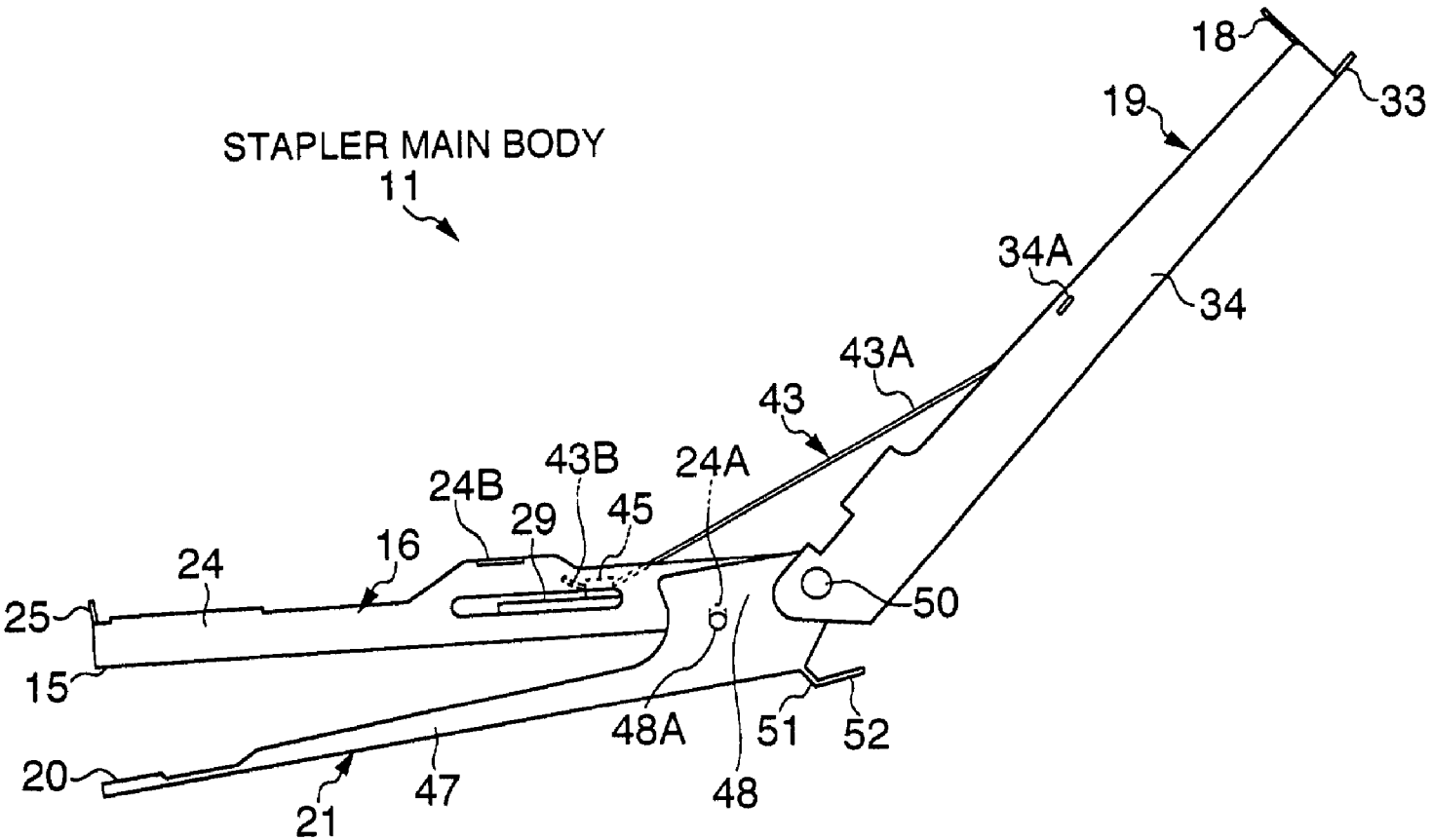
FIG. 3 is a side view showing a state in which the stapler main body is opened from the state in FIG. 2.

The stapler main body 11 is, as shown in FIG. 2, comprised of a frame 16 adapted to be capable of storing U-shaped staples 14 and impelling a staple 14 from an ejecting section 15 at the front end thereof, a handle 19 provided with a pusher blade 18 for impelling the staple 14, and a base 21 provided to these frame 16 and handle 19 to be capable of performing relative rotation with respect thereto and having an anvil 20 that serves as a receiving table for clinching the staple 14 impelled from the ejecting section 15.

Figure 4:
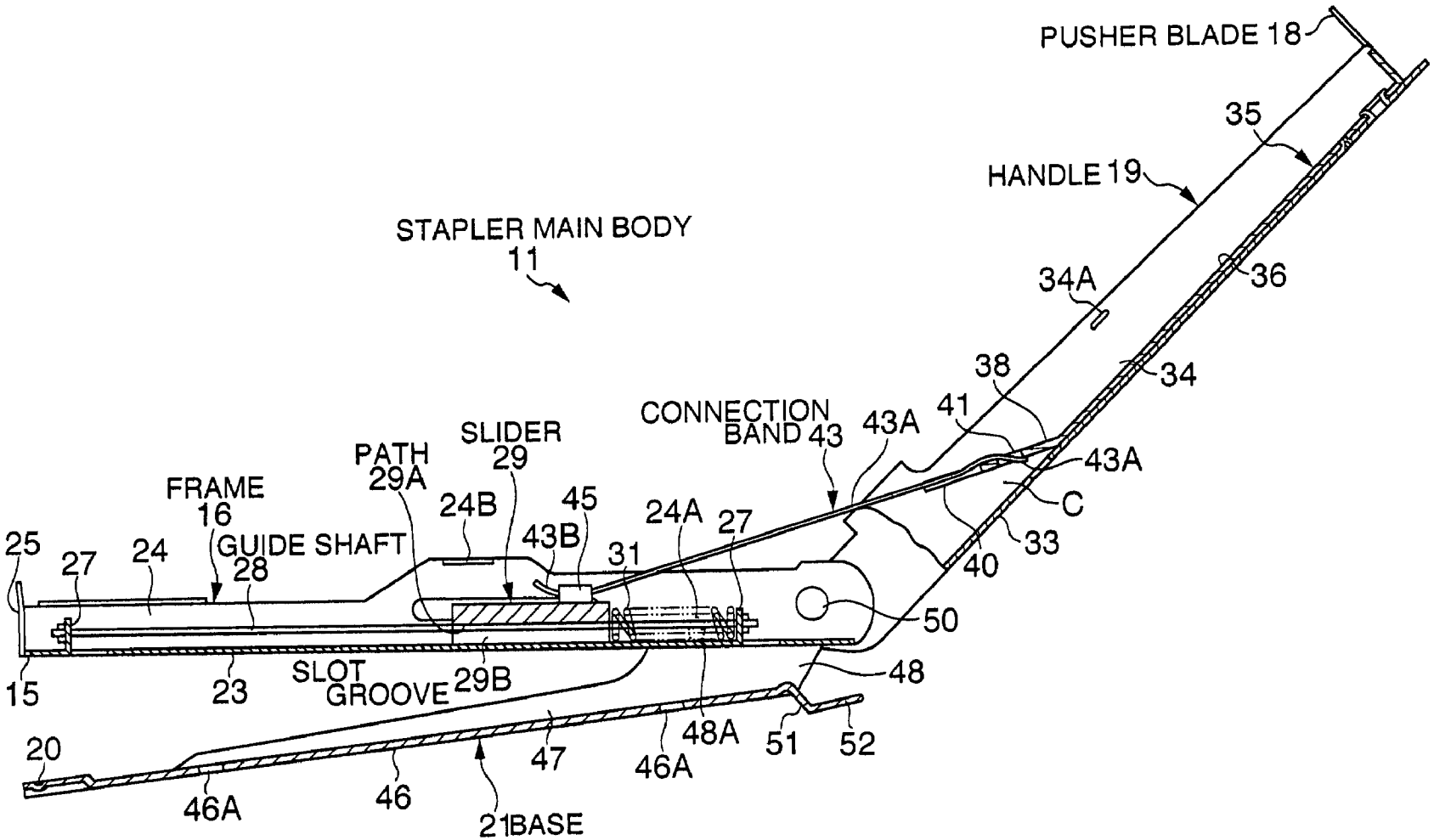
FIG. 4 is an enlarged side sectional view of FIG. 3.
Figure 5:
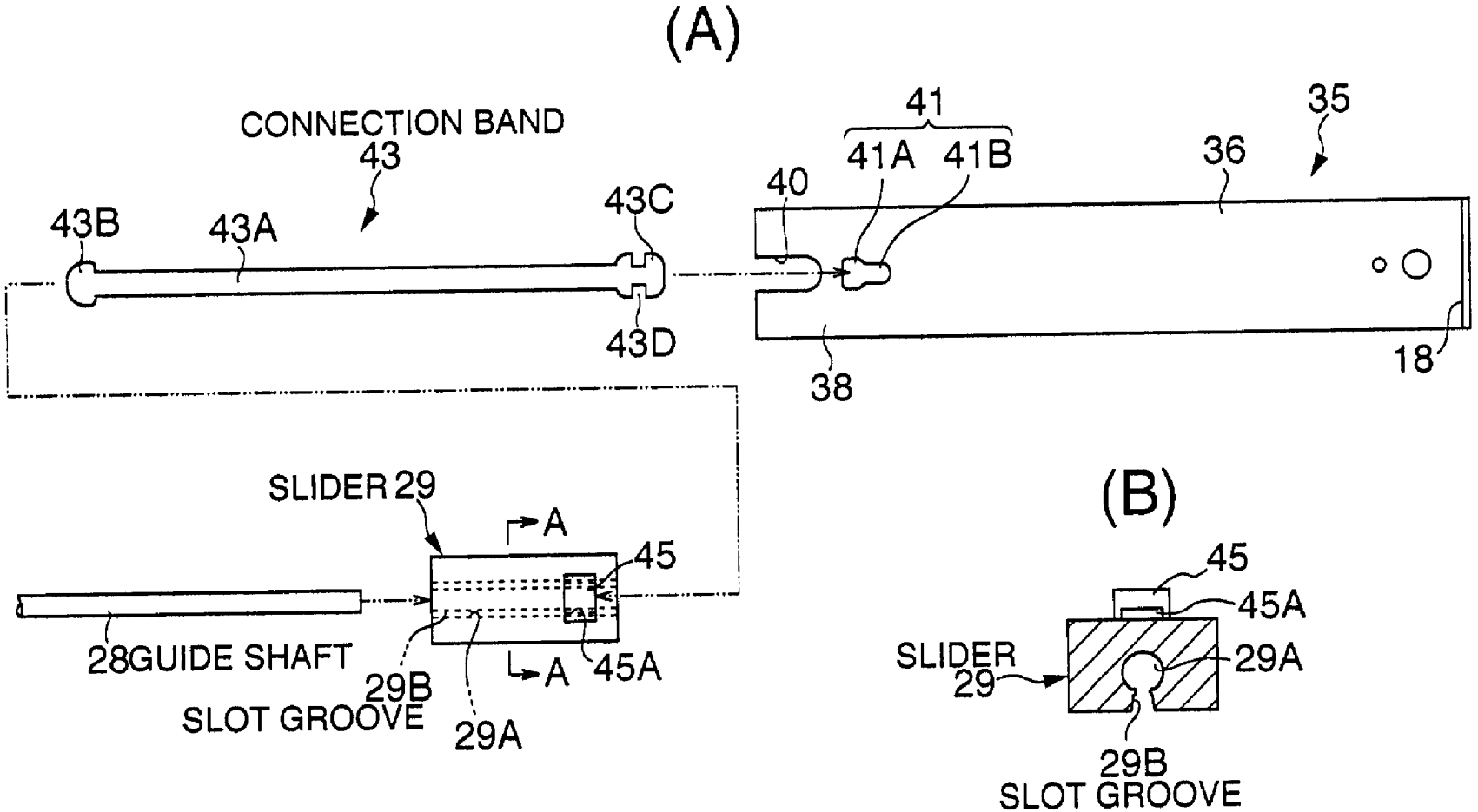
FIG. 5(A) is a plan view of disassembled parts in FIG. 3.
FIG. 5(B) is an enlarged sectional view of FIG. 5(A) taken along the line A—A viewed from the direction of the arrows.

The frame 16 is, as shown in FIG. 4, comprised of a bottom wall 23 formed into a roughly rectangular configuration viewed from the top, a pair of rising walls 24, 24 that rise upward from the both sides in the smaller width direction of the bottom wall 23(in the direction lies at right angle with respect to the drawing), a pusher blade guide wall 25 formed of the rising walls 24, 24 including the left end in the figure being bent inwardly respectively, a pair of right and left bearing pieces 27, 27, which are formed by cutting and bending the bottom wall 23 upwardly at two points, i.e., at the front and the rear thereof (right and left in FIG. 4), and a guide shaft 28 that bridges between these bearing pieces 27, 27 and extending in the front and rear direction of the frame 16. Mounted on the guide shaft 28 is a slider 29 made of resin that is movable back and forth along this guide shaft 28, and mounted around the guide shaft 28 between this slider 29 and the bearing piece 27 positioned at the rear side of the frame 16 is a coil spring 31. Accordingly, the slider 29, being pressed forwardly, makes the staple 14, which is at the front end, position at the ejecting section 15. Further, as shown in FIG. 5(A), since the slider 29 is provided with a path 29A, which goes through along the longitudinal direction thereof (right and left direction), and is provided with a slot groove 29B opened being linked with the path 29A at the bottom face thereof (refer to FIG. 5(B)), the guide shaft 28 can be positioned in the path 29A by positioning the guide shaft 28 in the slot groove 29B and pressing the same forcibly thereinto; and therefore, it is adapted so that the slider 29 does not drop off from the guide shaft 28 unless an external force to remove the same therefrom is given thereto.

The handle 19 is, as shown in FIG. 4, comprised of a top wall 33 which is roughly rectangular in configuration viewed from the top, a pair of perpendicular walls 34, 34, which lower down roughly perpendicularly from the both sides in the smaller width direction of the top wall 33 (in the direction lies at right angle with respect to the drawing of FIG. 4), and are capable of positioning at the outer side of the rising walls 24, 24 of the frame 16, and a pusher blade forming member 35 provided on the inner side of the top wall 33. The pusher blade forming member 35 is made of a sheet of metal plate, and is comprised of a plate-like portion 36, which is fixed on the inner surface of the top wall 33, and a pusher blade 18, which is formed by bending the front end of the plate-like portion 36 by roughly 90 degrees. The plate-like portion 36 is supported in a manner of cantilever by being calked at the front-end side of the top wall 33, and the rear-end side of the plate-like portion 36 is formed into a slanted portion 38 extending in the direction that the same gradually parts away from the top wall 33 so as to form a space C between the top wall 33 and the same. As shown in FIG. 5(A), formed on the slanted portion 38 are a notched portion 40, which is roughly positioned at the center of the one end thereof in the longitudinal direction (in the right and left direction), and a hole 41, which is positioned at the right side of the notched portion 40, and whose opening width along the smaller width direction of the plate-like portion 36 is formed into two steps. The hole 41 is comprised of a first hole 41A and a second hole 41B, which is linked therewith, and is adapted so that the opening width of the second hole 41B is smaller than that of the first hole 41A.

Between the slider 29 and the handle 19, a flat connection band 43 made of resin is bridged. The connection band 43 is, as shown in FIG. 5(A), comprised of a main piece 43A, which is thin and long in configuration, a first end portion 43B, which is formed at the one end of the main piece 43A and is held by the slider 29 so as not to be detached therefrom, and a second end portion 43C, which is formed at the other end side of the main piece 43A and is fixed to the hole 41. The first end portion 43B is formed so that the width thereof is slightly larger than that of the main piece 43A, and is held by the support block 45 so as not to be detached therefrom by inserting the first end portion 43B forcibly into a slot hole 45A of the support block 45 formed on the upper face of the slider 29. On the other hand, the second end portion 43C is formed into an approximate H-shape having a narrower portion 43D in the middle viewed from the top. The second end portion 43C is formed so that the width thereof is larger than that of the first hole 41A, and is larger than the length in the direction that the first and the second holes 41A, 41B are linked with each other. Accordingly, after inserting the second end portion 43C into the hole 41, by hooking the second end portion 43C on the first hole 41A; i.e., owing to the fact that the narrower portion 43D is fixed at a position between the top and bottom edges of the first hole 41A in FIG. 5(A), it is possible to hold the same at the fixed position. When the handle 19 is positioned so that the same covers the frame 16, the connection band 43 is adapted so that the first end portion 43B slides within the support block 45 so as to position in front of the support block 45; therefore, there is no possibility that the connection band 43 is bent.

The base 21 is, as shown in FIG. 4, comprised of a base bottom wall 46, which is thin and long plate-like in configuration, and at the front end side thereof, the anvil 20 is formed, and a pair of base side walls 47, 47 rising upwardly from the both ends in the direction of smaller width of the base bottom wall 46. The rear portion of these base side walls 47, 47 are formed so that the rising height is relatively larger than that of the front portion so as to serve as a pair of bearing wings 48, 48, and are linked with each other via a shaft pin 50 to be capable of performing relative rotation in a state that the bearing wings 48, 48 are positioned respectively between the rising wall 24 of the frame 16 and the perpendicular wall 34 of the handle 19. Also, formed at the front and rear two points in the base bottom wall 46 are holes 46A, 46A for engaging with the base cover, which will be described later, and formed into a steepled pawl-like configuration at the rear end of the base bottom wall 46 is a remover 52 extending further outwardly via a bent portion 51.

Further, formed in the face of the bearing wing 48 is a stopper 48A, which is the face thereof caved-in inwardly using an appropriate pressing means, and the stopper 48A is adapted to be capable of engaging with a hole 24A formed in the rising wall 24 of the frame 16. Furthermore, formed at the top end of the rising wall 24 in the roughly central area thereof is a stopper rib 24B, and the stopper rib 24B is adapted so as to engage with a rib 34A formed in the inner face side of the perpendicular wall 34 of the handle 19.

The cover 12 is comprised of an upper cover 55, which is positioned at the handle 19 side so as to cover the outer side of the handle 19, and a base cover 56, which is linked with the upper cover 55 rotatably with respect thereto so as to cover the base 21. The upper cover 55 is, as shown in FIG. 6–FIG. 10, comprised of an upper wall 57, which is positioned at the top wall 33 side constituting the upper face side of the handle 19, a pair of side walls 58, 58, which lower perpendicularly from the both sides in the smaller width direction of the upper wall 57, and a front wall 59, which is positioned at the front end side of these side walls 58, 58 (left end in FIG. 6).

Figure 6:
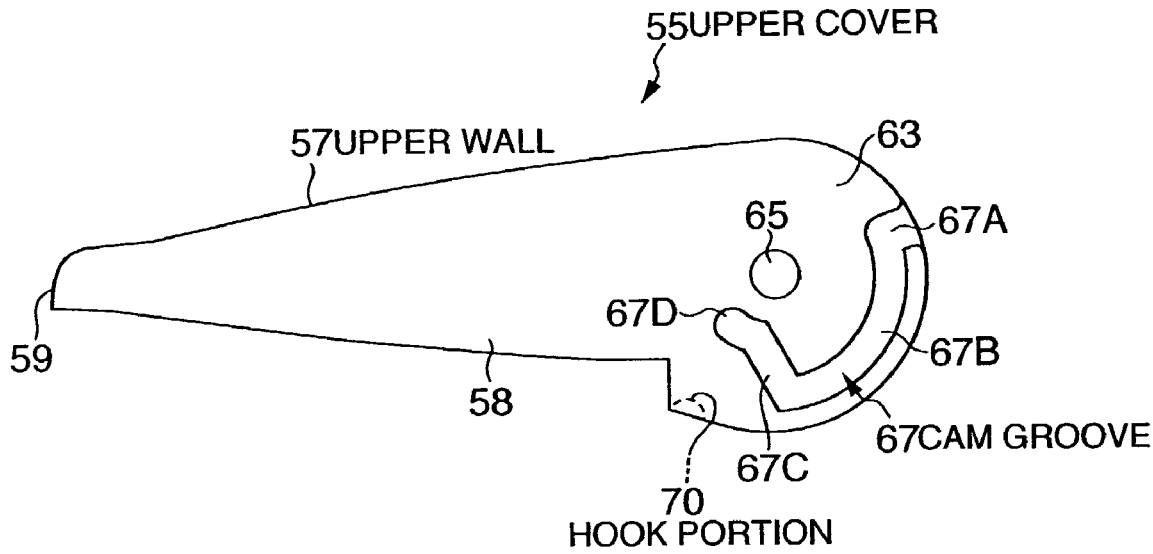
FIG. 6 is a side view of an upper cover.
Figure 7:
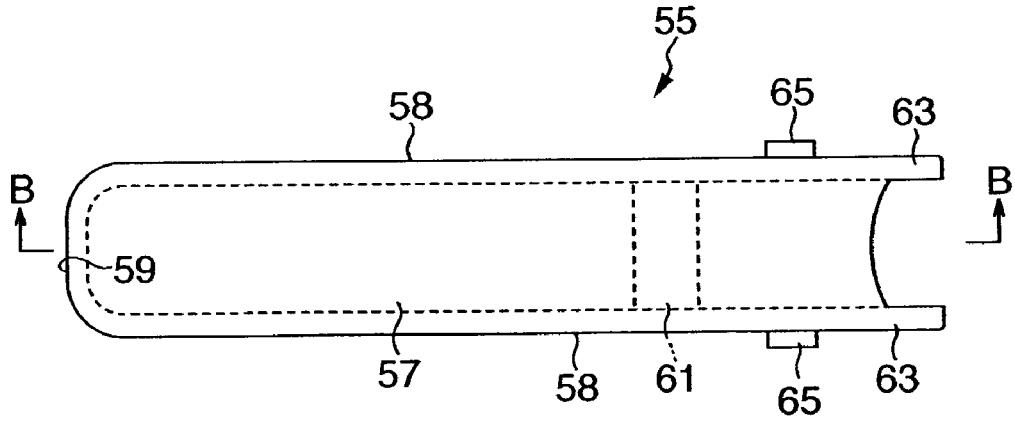
FIG. 7 is a plan view of FIG. 6.
Figure 8:
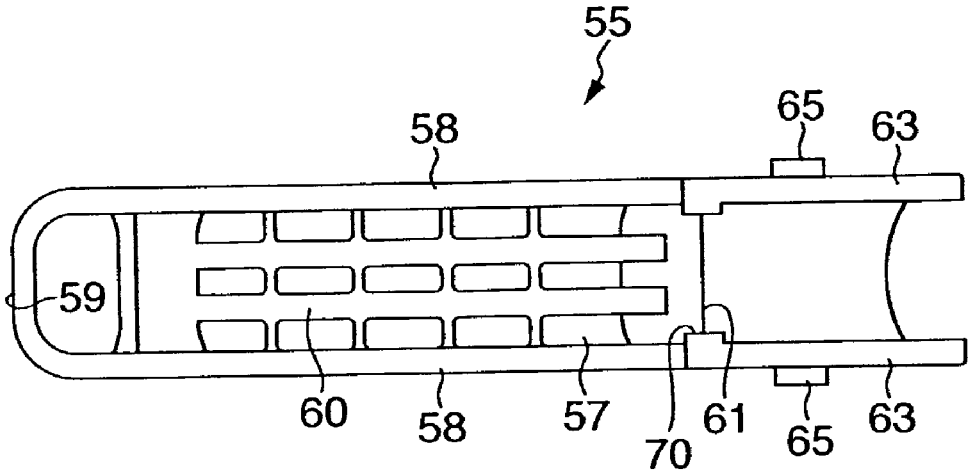
FIG. 8 is a bottom view of FIG. 6.
Figure 10:
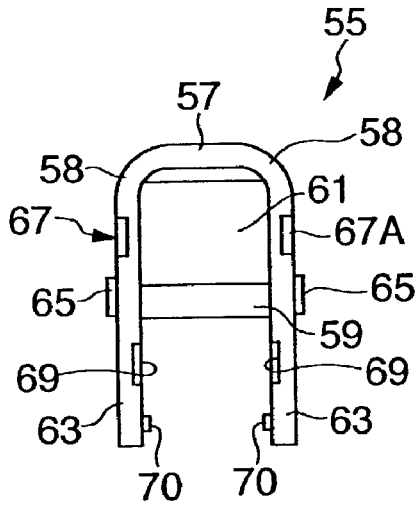
FIG. 10 is a right side view of FIG. 6.
Figure 11:
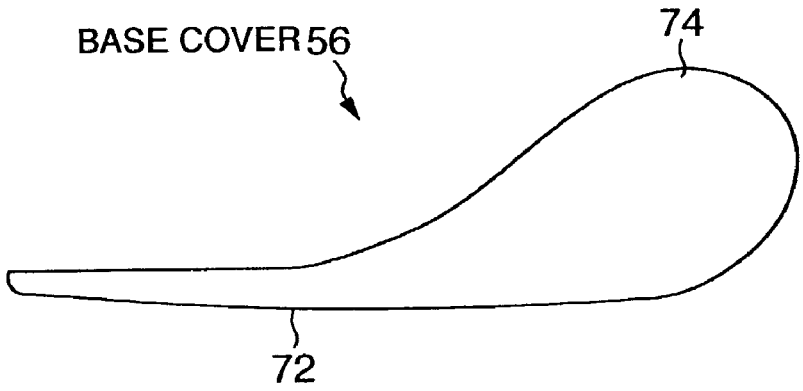
FIG. 11 is a side view of a base cover.
Figure 12:
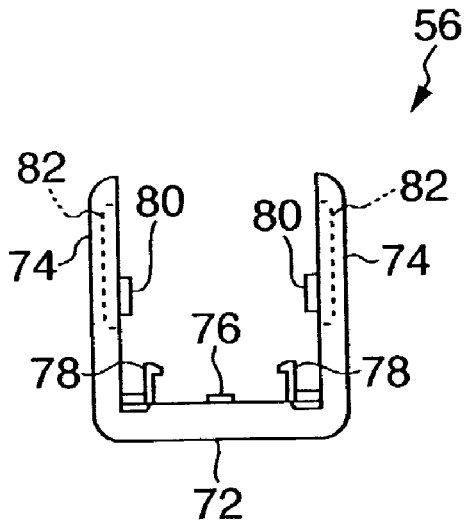
FIG. 12 is a right side view of FIG. 11.
Figure 13:
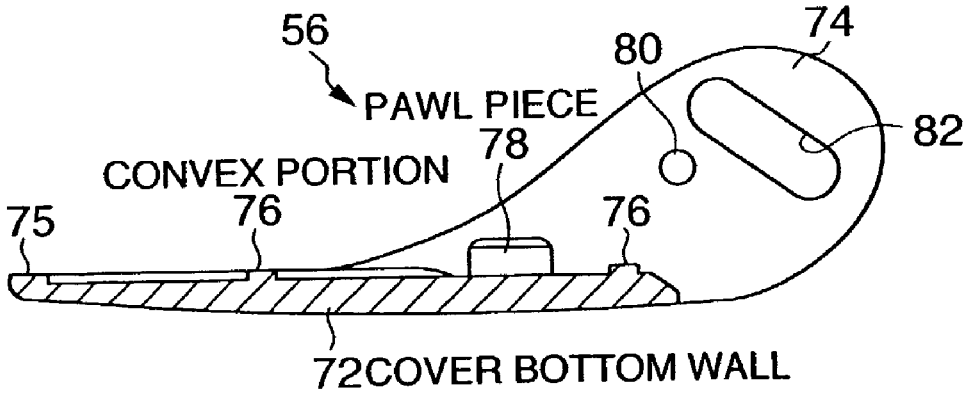
FIG. 13 is a sectional view of FIG. 14 taken along the line C—C viewed from the direction of the arrows.
Figure 14:
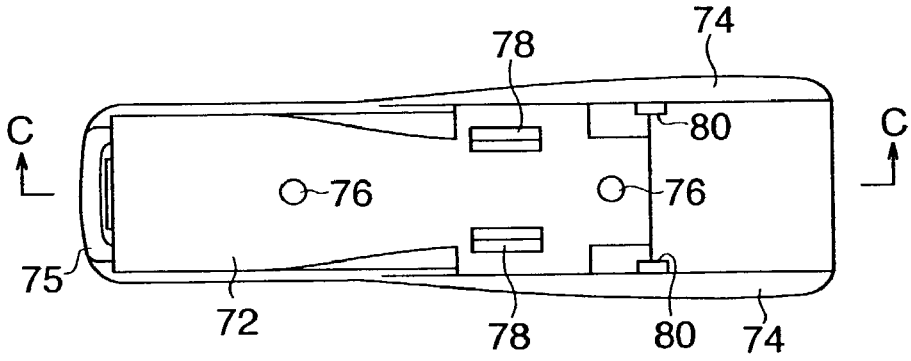
FIG. 14 is a plan view of the base cover.

In the upper wall 57, formed in the inner face side thereof excluding the rear area are reinforcement ribs 60, which are roughly lattice-like configuration viewed from the top, and formed in the rear area behind the reinforcement ribs 60 is a pressing section 61, which is roughly triangle-like configuration viewed in a side section thereof. Also, the side wall 58 is formed in a plane-like configuration so that the height thereof increases toward the rear direction, and the area behind the pressing section 61 is formed in a roughly disk-like plane and is provided so as to serve as the inner bearing plane sections 63, 63 respectively. As shown in FIG. 6 and FIG. 10, formed in the roughly central area on the outer face of the bearing plane sections 63, 63 are protrusion shafts 65, 65 constituting a cam mechanism respectively, and formed in the area of roughly 180 degrees around these protrusion shafts 65, 65 are cam grooves 67, 67 constituting the cam mechanism respectively. Each cam groove 67 is constituted of an open side groove portion 67A, which opens in the upper-rear end of the inner bearing plane section 63, an arc-like groove portion 67B, which extends on a roughly concentric circle with respect to the protrusion shaft 65 being linked with the open side groove portion 67A, a linear groove portion 67C, which extends in the direction of the roughly tangent of the protrusion shaft 65 being linked with the arc-like groove portion 67B, and a closed-end side groove portion 67D, which is linked with the linear groove portion 67C and is oriented in a slightly bent direction with respect to the extending direction of the linear groove portion 67C.

Figure 9:
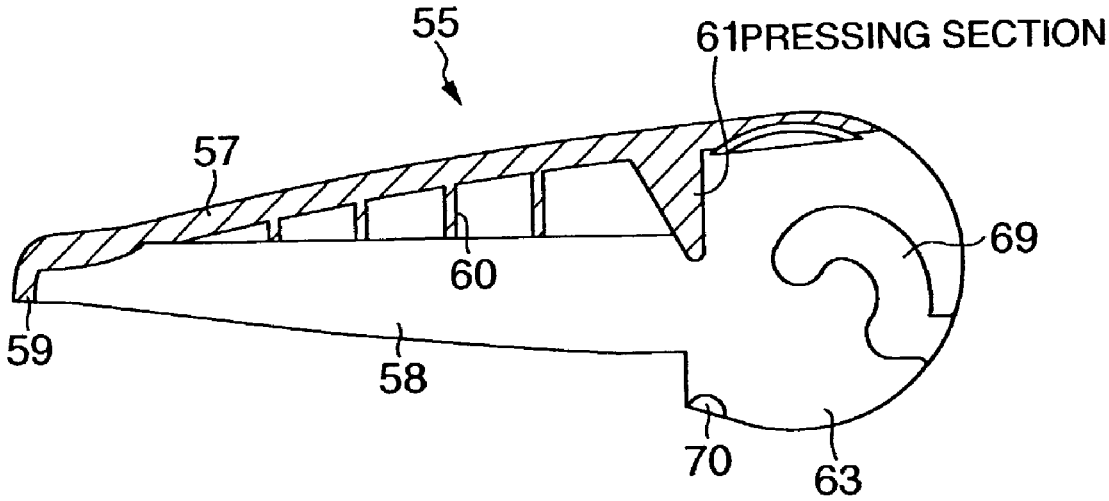
FIG. 9 is a sectional view of FIG. 7 taken along the line B—B viewed from the direction of the arrows.

On the other hand, as shown in FIG. 9, formed in the inner face side of the inner bearing plane section 63 is a bearing groove 69, which is capable of receiving the shaft pin 50 constituting the rotation shaft of the stapler main body 11 along the side wall 58; i.e., in the direction of the face of the inner bearing plane section 63. The bearing groove 69 is formed into such a configuration that the same extends along the roughly C-shaped trace and one end thereof is positioned at the roughly central area of the inner bearing plane section 63; and the other end thereof opens in the lower-rear end side of the inner bearing plane section 63. Further, in the inner bearing plane section 63, formed in the corner area of the lower-inner face is a hook portion 70 of a convex shape, which is capable of engaging with the lower end of the perpendicular wall 34 of the handle 19.

The upper cover 55 is adapted in a length so that the front end thereof, i.e., the front wall 59 extends largely exceeding the front end of the handle 19; in this embodiment, although not limited particularly, it is adapted so that the front wall 59 is positioned at a point approximately 20 mm away in front of the pusher blade 18.

The base cover 56 is, as shown in FIG. 11-FIG. 14, comprised of a cover bottom wall 72, which is positioned at the bottom face side of the base 21 of the stapler main body 11, and a pair of outer bearing plane sections 74, 74, which rise upwardly from the both sides in the direction of the smaller width of the cover bottom wall 72, are formed so that the height thereof increases toward the rear side, and the rear end edges thereof are formed in arc-like configuration so as to be positioned at the outer face side of the inner bearing plane section 63. The front-outer edge of the cover bottom wall 72 is formed as a front frame portion 75, which slightly rises up at a level roughly corresponding to the plate thickness of the base 21, and the front frame portion 75 is adapted so as to position at a point exceeding the anvil of the base 21. Also, in the face of the cover bottom wall 72, provided at front and rear two areas are convex portions 76, 76, which are capable of engaging with the holes 46A, 46A formed in the base 21, and provided at the positions slightly in front of the rear side convex portion 76 are a pair of pawl pieces 78 as the holders, which are capable of engaging with the upper ends of the base side wall 47 constituting the outer line of the base 21.

Figure 15:
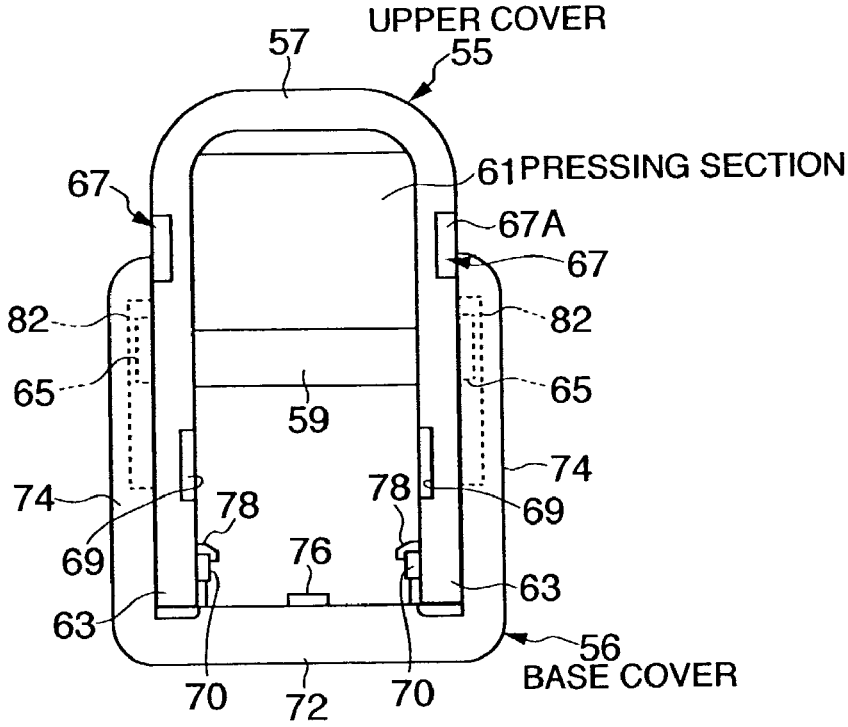
FIG. 15 is an enlarged right side view showing a state in which the upper cover and the base cover are connected to each other.

In the outer bearing plane sections 74, 74 of the base cover 56, provided in the inner face side respectively are circular convex portions 80, 80, which are positioned in the cam groves 67, 67 respectively constituting the cam mechanisms along with the cam grooves 67, and also, fromed therein are the supporting grooves 82, 82 that constitutes the elongated circular cam mechanism for receiving the protrusion shafts 65, 65, respectively, of the upper cover (refer to FIG. 15). While the front end of the repective supporting grooves 82, 82 is positioned higher than the circular convex portion 80, the rear end thereof is positioned slightly lower than the circular convex portion 80 being oriented downwardly, and it is adapted so that the circular convex portion 80 can move along this slant direction. According to the embodiment, since the outer bearing plane section 74 is provided outside of the inner bearing plane section of the upper cover 55, when a hand grips the stapler 10, four fingers except the thumb are allowed to fit on the base cover 56 easily, and the pressing operation of the upper cover 55 can also be carried out smoothly. Here, the front end and rear end of the respective supporting grooves 82, 82 are formed as concave portions 82B, 82B, in which the face position thereof is further recessed via the step portions 82A, 82A, and it is adapted so that the protrusions shafts 65 are allowed to engage selectively with these concave portions 82B, 82B. Next, referring to FIG. 16–FIG. 25, mounting and dismounting steps of the stapler main body 11 and the covers 12 and the operation of the stapler 10 according to the embodiment will be described.

Figure 16:
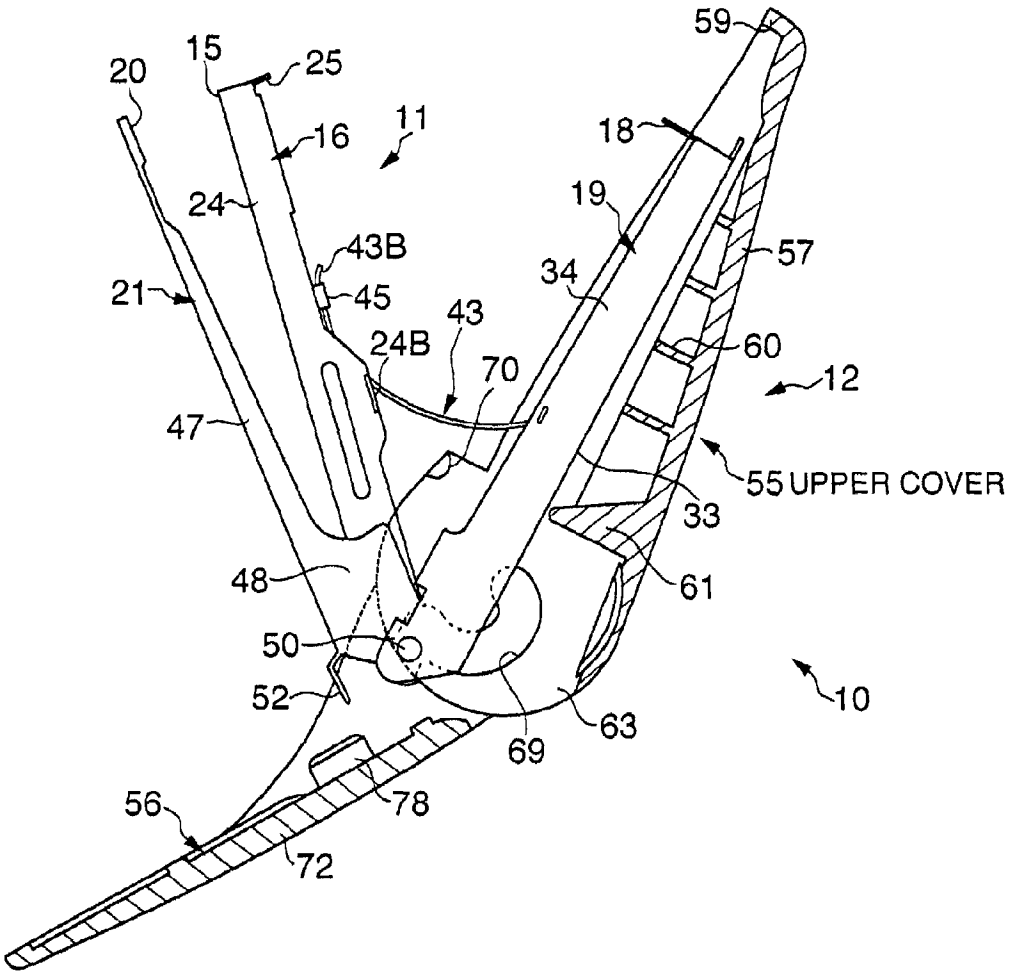
FIG. 16 is a view illustrating the initial stage of the operation to mount the stapler main body to the covers.
Figure 22:
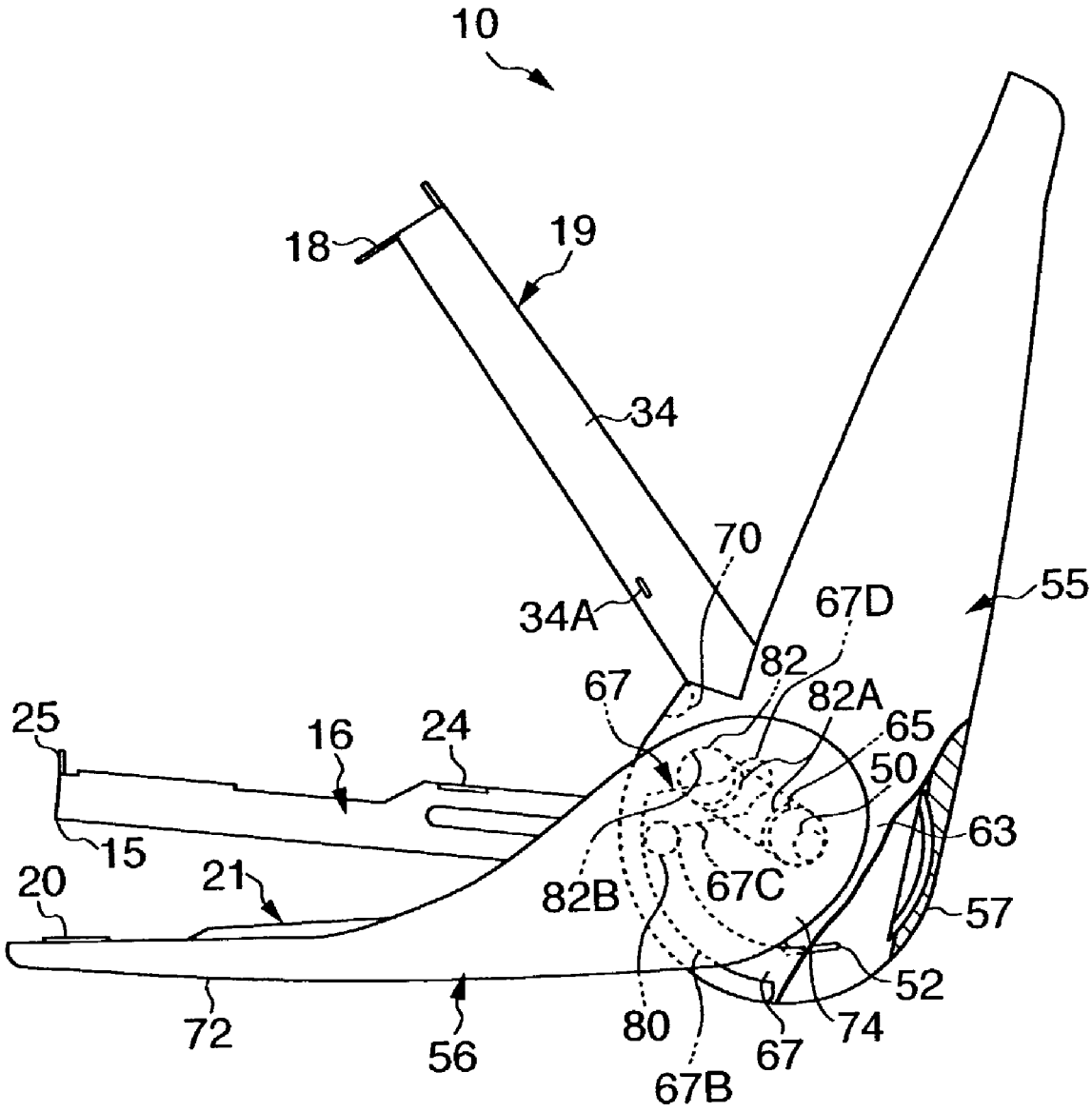
FIG. 22 is a view illustrating a state in which the upper cover is retracted from the rear end of the base cover.

First of all, the protrusion shaft 65 (refer to FIG. 22) of the upper cover 55 is positioned in the supporting groove 82 of the base cover 56 and both of them are connected to each other integrally, and then, both of them are held by a hand while the respective front ends of the upper cover 55 and the base cover 56 are separated from each other (refer to FIG. 16). In this state, as shown in FIG. 22, since the circular convex portion 80 in the cam groove 67, which constitutes the cam mechanism, is positioned in the area of the arc-like groove portion 67B, the protrusion shaft 65 is shifted to the position of rear end side of the supporting groove 82. In this state, as shown in FIG. 16, while holding the stapler main body 11 with the other hand in a posture that the top wall 33 of the handle 19 faces toward the upper cover 55 side, the front end of the handle 19 is inserted from the rear end side of the inner bearing plane section 63. And then, the shaft pin 50 of the stapler main body 11 is positioned in the bearing groove 69. At this time, it is necessary to insert the handle 19 so that the same passes through the area between the pressing section 61 and the hook portion 70.

Figure 17:
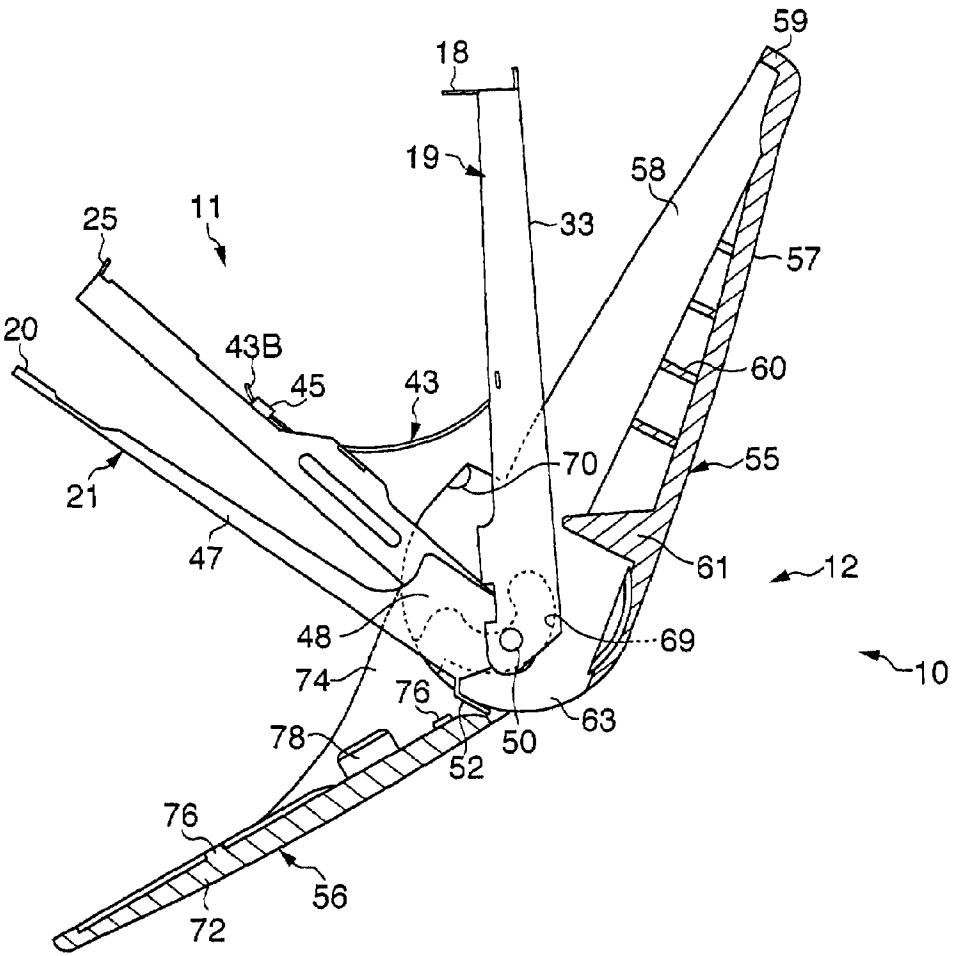
FIG. 17 is a view illustrating the stage of the operation next to the stage in FIG. 16.
Figure 18:
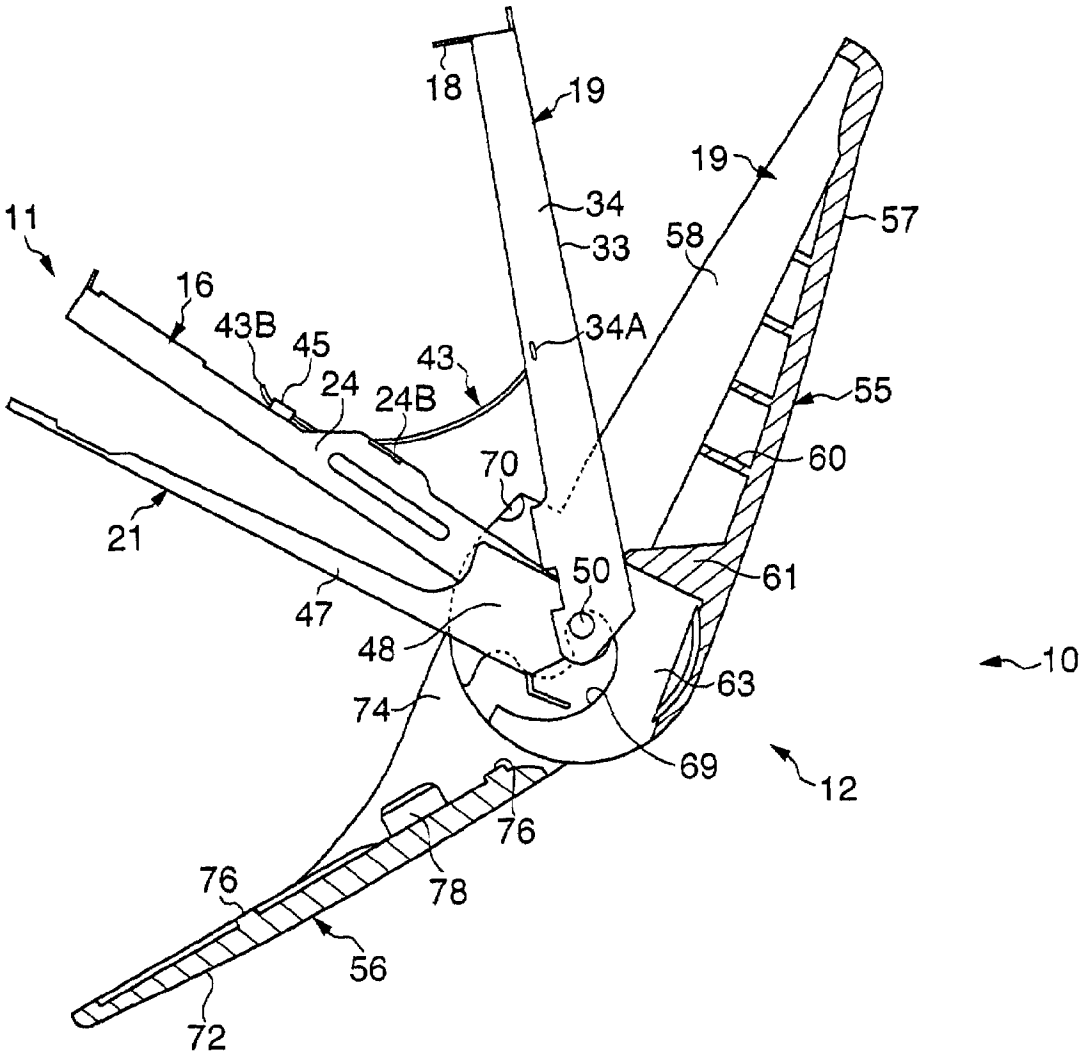
FIG. 18 is a view illustrating the stage of the operation further next to FIG. 17.
Figure 19:
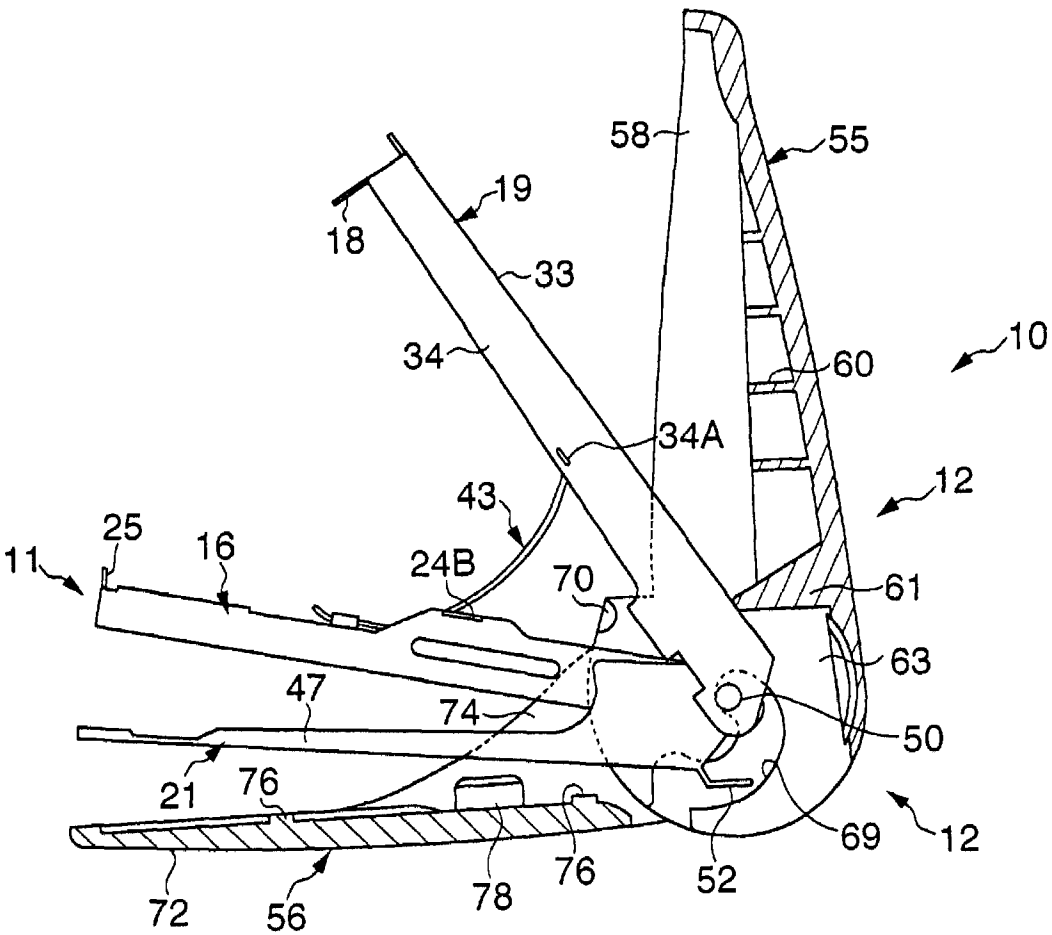
FIG. 19 is a view illustrating the stage next to the stage in FIG. 18.

Next, as shown in FIG. 17, the stapler main body 11 is rotated counterclockwise while being further inserted so that the shaft pin 50 is shifted along the bearing groove 69 to a further advanced position. In a state that the position of the shaft pin 50 has been shifted up to the front-end side of the bearing groove 69 by the rotation, the stapler main body 11 is further rotated counterclockwise (refer to FIG. 18 and FIG. 19). Then, while holding the base 21 of the stapler main body 11 so that the same faces to the cover bottom wall 72 of the base cover 56, when a pressing force is given thereto from the top, the convex portions 76, 76 of the cover bottom wall 72 engage into the holes 46A, 46A of the base 21, and the pawl pieces 78, 78 hook at the upper end of the base side walls 47, 47 emitting a sound "click" (refer to FIG. 20). Thus, when the base 21 has been mounted in a state that the same is held by the base cover 56, the base 21 is restrained from moving along the direction of the face of the base bottom wall 46 and from lifting upwardly; further the position of the shaft pin 50 is positioned roughly at the center of the bearing groove 69, and the position of the rotation center of the stapler main body 11 is maintained at that position.

Figure 20:
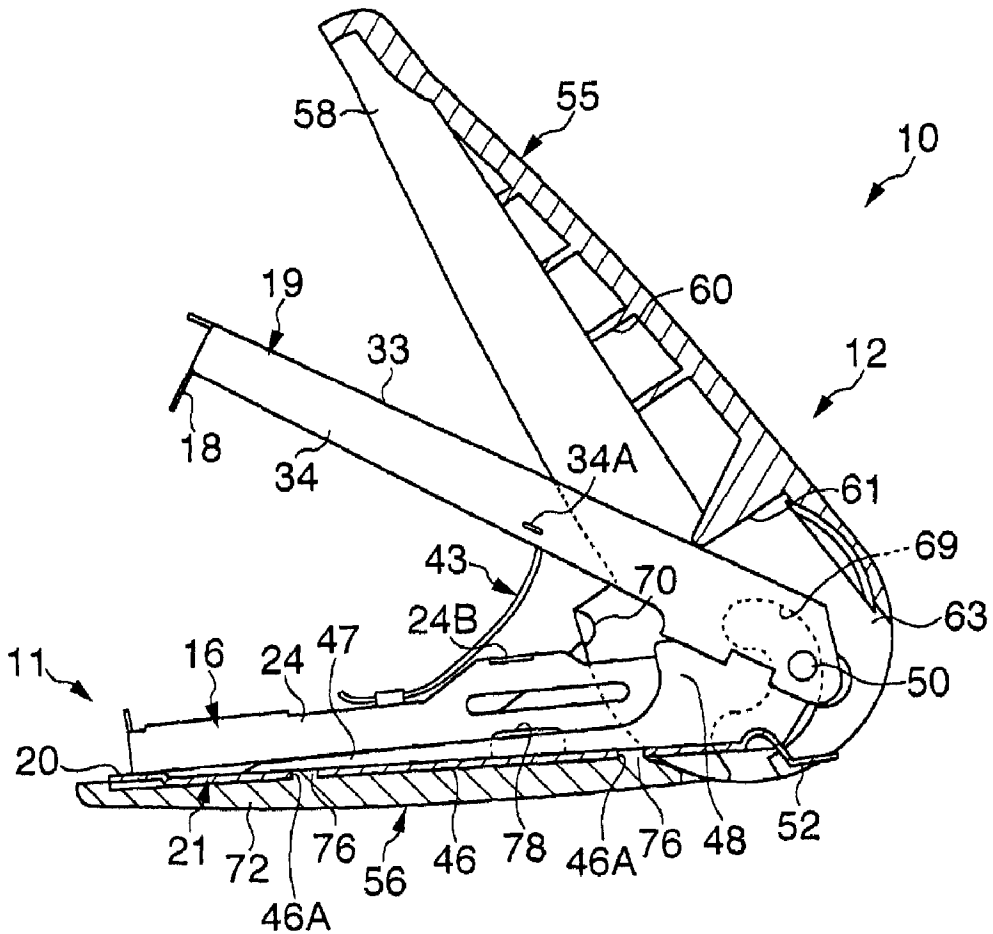
FIG. 20 is a view illustrating the operation in a state that the base of the stapler main body is mounted to the base cover.
Figure 21:
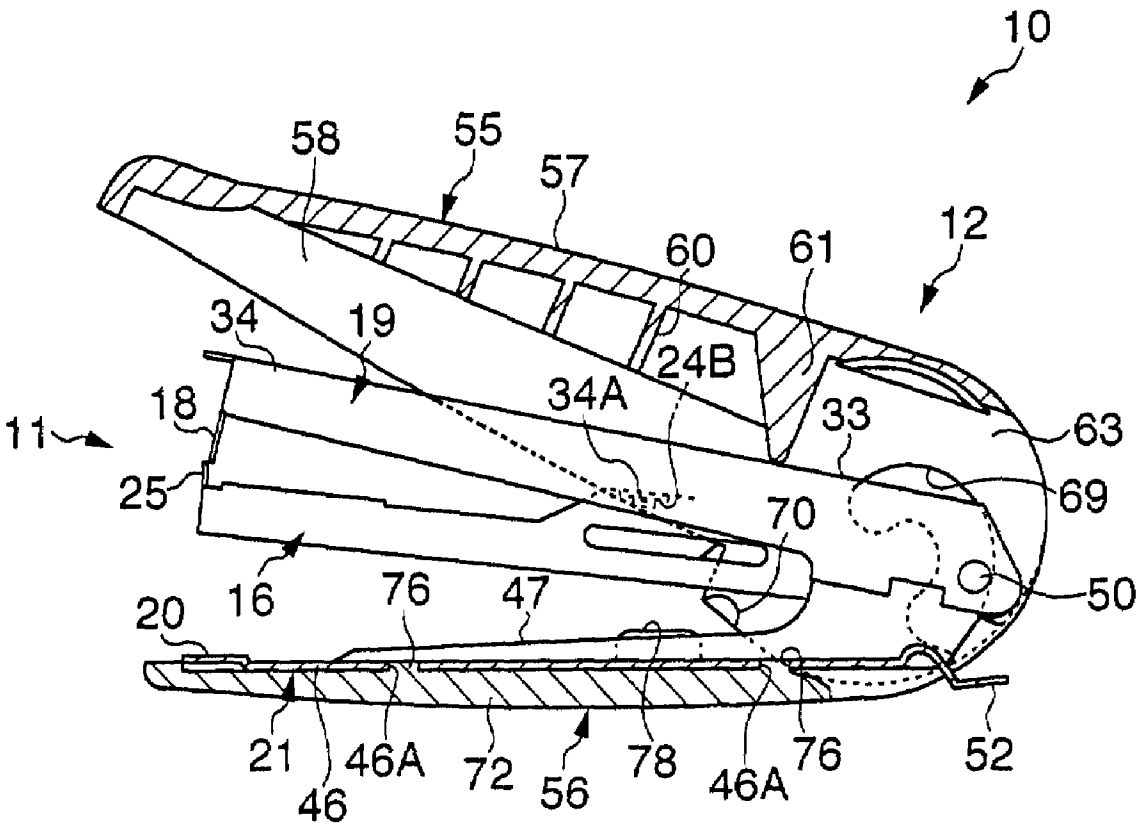
FIG. 21 is a view illustrating the final stage in which the stapler main body is mounted to the covers into a state that the same is usable as a stapler.

Then, from the position shown in FIG. 20, when a press-down force is given to the upper cover 55, the handle 19 rotates counterclockwise, and as shown in FIG. 21, the rib 34A of the perpendicular wall 34 climbs over the stopper rib 24B of the frame 16 and is positioned lower than the stopper rib 24B, and the pusher blade 18 of the handle 19 is always held at the position to eject the staple 14; thus, the mounting operation of the stapler main body 11 to the cover 11 is completed. On the other hand, when dismounting the stapler main body 11, using a flat-pointed screwdriver, the tip thereof is inserted between the base bottom wall 46 and the cover bottom wall 72 of the base cover 56, and the base bottom wall 46 is lifted up. Owing to this, the base bottom wall 46 is released from the engagement between the hole 46A and the convex portion 76, and the base side wall 47 is unhooked from the pawl piece 78, the same gets free with respect to the cover 12. Accordingly, after that, by following the aforementioned steps in reverse, the stapler main body 11 can be removed from the cover 12.

Figure 24:
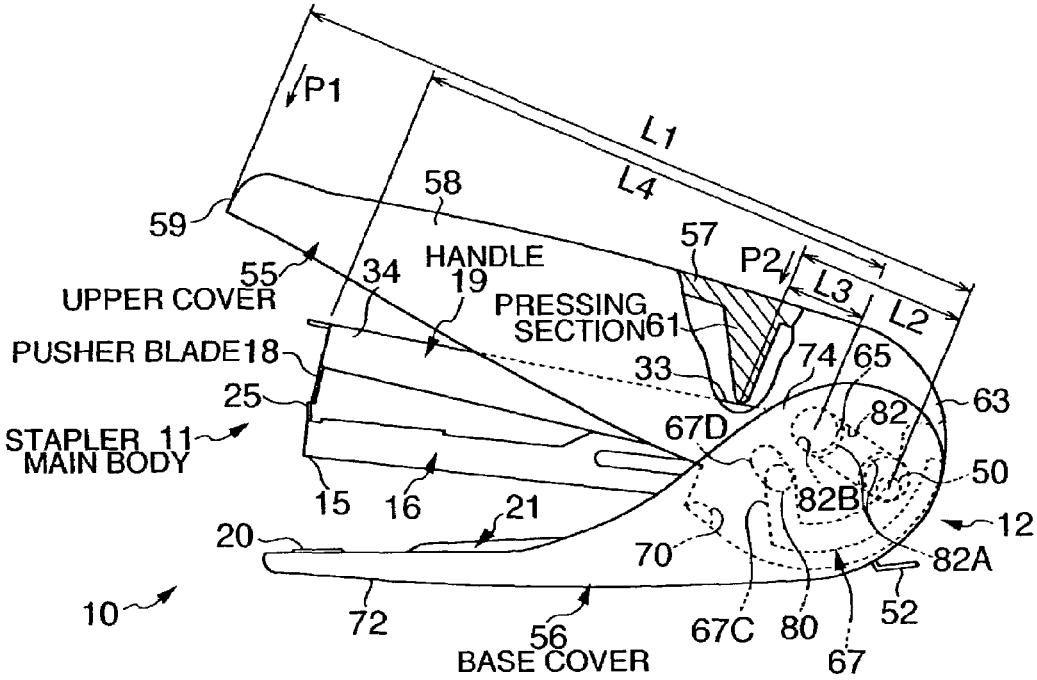
FIG. 24 is a side view illustrating the principle to reduce the operation force of the stapler.
Figure 25:
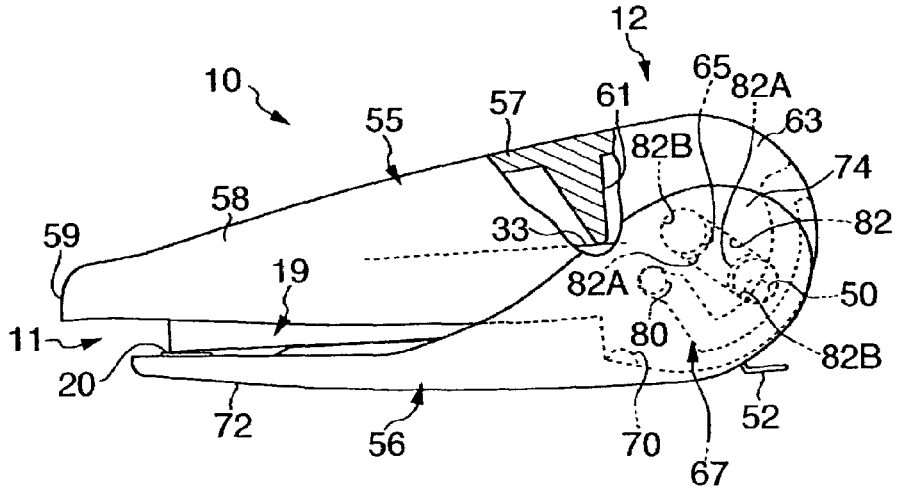
FIG. 25 is a side view showing a state of the stapler when a staple is impelled.

In the state that the stapler main body 11 is mounted to the cover 12; i.e., in the operable state as shown in FIG. 21 and FIG. 24, the protrusion shaft 65 of the upper cover 55 side (refer to FIG. 24) is positioned at the front end side of the supporting groove 82, the circular convex portion 80 in the cam groove 67 is positioned in the closed-end side groove portion 67D of the cam groove 67, and the rear end of the inner bearing plane section 63 of the upper cover 55 is positioned at the position roughly corresponding to the rear end of the outer bearing plane section 74 of the base cover 56.

Figure 23:
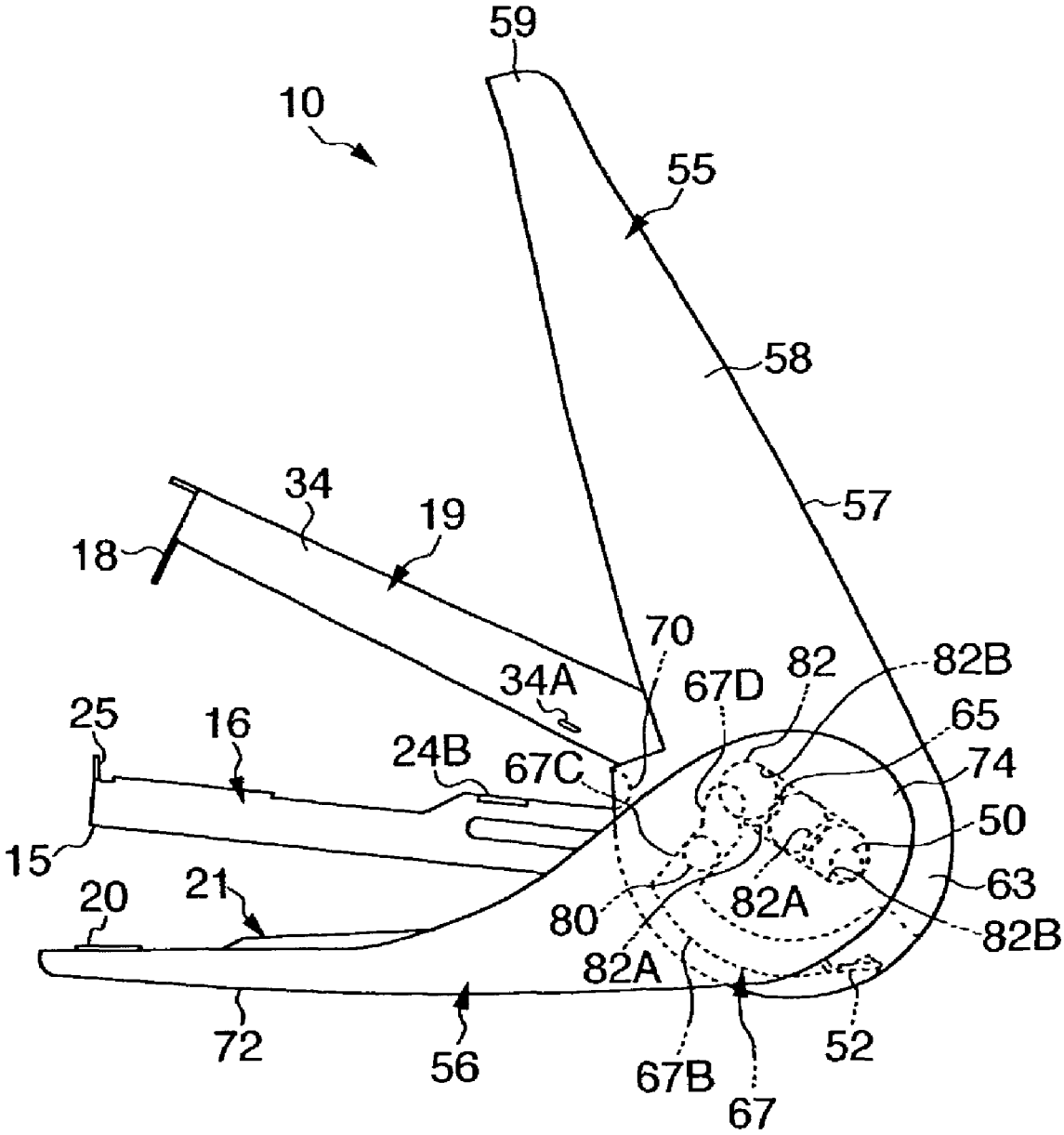
FIG. 23 is a view illustrating the position of a protrusion shaft and a state of a cam mechanism when the upper cover is rotated in the counterclockwise direction from the position in FIG. 22.

On the other hand, as shown in FIG. 22, in a state that, when mounting the stapler main body 11 to the covers 12, the upper cover 55 and the base cover 56 are opened, the circular convex portion 80 is shifted to the arc-like groove portion 67B area of the cam groove 67, and the protrusion shaft 65 shifts to the rear end side of the supporting groove 82. Accordingly, since the rear end portion of the upper cover 55; i.e., the inner bearing plane section 63 shifts to a recessed position with respect to the outer bearing plane section 74 of the base cover 56, when mounting the stapler main body 11 to the covers 12, positional interference between the remover 52 and the upper wall 57 of the upper cover 55 is avoided. And in the process that the upper cover 55 is made to rotate after the base 21 of the stapler main body 11 is mounted to the base cover 56, as shown in FIG. 23, the circular convex portion 80 shifts from the arc-like groove portion 67B to the linear groove portion 67C, and at the same time, when the protrusion shaft 65 shifts from the rear end side of the supporting groove 82 to the front end side thereof and the protrusion shaft 65 shifts to the front end side of the supporting groove 82, the rear end sides of the inner bearing plane section 63 and the outer bearing plane section 74 roughly coincide with each other (refer to FIG. 21 and FIG. 24).

As shown in FIG. 24, in the state that the stapler 10 is usable, since the protrusion shaft 65 is positioned in a state that the same is engaged with the concave portion 82B formed in the front end area of the supporting groove 82, and the circular convex portion 80 is positioned immediately close to the linear groove portion 67C in the closed-end side groove portion 67D of the cam groove 67, a state, in which a resistance against the rotation in clockwise direction to maintain the front wall 59 of the upper cover 55 at a specific position is given, is obtained. Accordingly, since the lower end of the pressing section 61 of the upper cover 55 is maintained in a state that the same is brought roughly into contact with the top wall 33 without swinging with respect to the handle 19 resulting in a preferable responsiveness in which the pressing operating force to the upper cover 55 is immediately transmitted to the handle 19.

Now, when the staple 14 in the frame 16 has been consumed and new staples are loaded, it is enough to rotate the upper cover 55 in the direction of opening largely with respect to the base cover 56. Since it is such structured that, when the upper cover 55 is rotated, the hook portion 70 of the upper cover 55 hooks at the bottom of the perpendicular wall 34 of the handle 19, the rib 34A provided to the perpendicular wall 34 is released from the engagement with the stopper rib 24B of the frame 16 and rotates along with the upper cover 55 (refer to FIG. 22). Accordingly, since one end of the connection band 43 is fixed at the handle 19 side, the slider 29 in the frame 16 moves toward the rear side of the frame 16 against the force of the aforementioned coil spring 31, and owing to this, new staples 14 can be loaded. Further, in the state as described above, since the protrusion shaft 65 engages with the concave portion 82B of the rear end portion in the supporting groove 82 of the base cover 56, the upper cover 55 and the base cover 56 are strained from swinging in the rotation direction with respect to each other.

Since the slider 29 can be removed from the guide shaft 28 using a flat-pointed screwdriver, and the second end portion 43C of the connection band 43 can be pulled out from the hole 41 at the handle 19 side, it is possible to remove the parts made of resin only from the stapler main body 11 made of metal.

Next, the principle of the reduction of operation force of the stapler 10 will be described. As shown in FIG. 24, the center of the relative rotation of the handle 19 and the base 21, which constitute the stapler main body 11, resides in the position of the shaft pin 50, and is behind the center position of the protrusion shaft 65 that is the center of relative rotation of the upper cover 55 and the base cover 56. Further, the contact position of the pressing section 61 with the top wall 33 of the handle 19 resides in front of the protrusion shaft 65. Accordingly, assuming that the operation force required for a current type stapler; i.e., stapling load is 10 Kg; the distance L1 between the rotation center of the stapler main body 11 and the position of the front wall 59 of the upper cover 55 is 102 mm; the distance L2 between the rotation center and the front end of the pressing section 61 is 23 mm; the distance L3 between the rotation center of the cover 12; i.e., the center of the protrusion shaft 65 and the front end of the pressing section 61 is 11 mm; and further assuming that the distance L4 between the rotation center of the cover 12 and the point where the stapling load P1 is applied is 70 mm, the stapling load P2 required at the front end of the pressing section 61 becomes as below:

$$P2=10\ \text{Kg}\times 102\ \text{mm}\div 23=23.46\ \text{Kg}.$$

Consequently, the stapling load P1 required at the front end of the upper cover 55 becomes as below:

$$P1=23.46\ \text{Kg}\times 11\ \text{mm}\div 70=3.68\ \text{Kg}.$$

As demonstrated above, in the structure according to the embodiment, compared to the conventional type, a large reduction of the operation force can be achieved.

Figure 26:
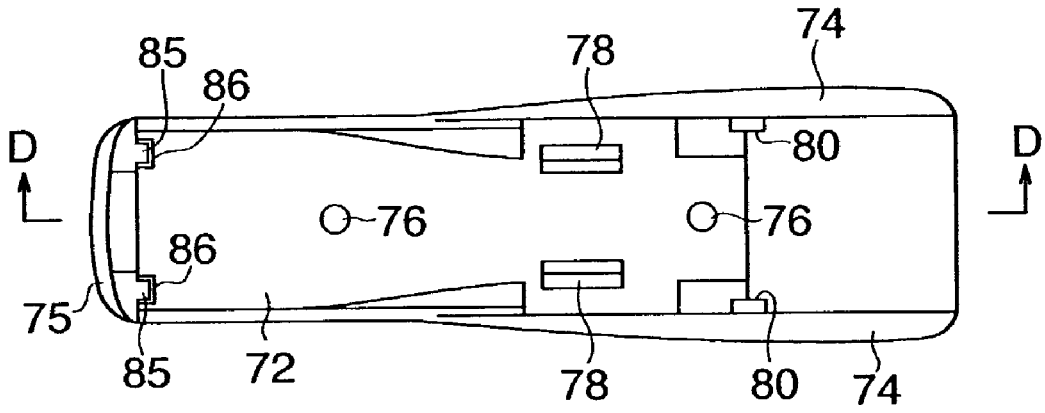
FIG. 26 is a plan view showing a modification of the base cover.
Figure 27:
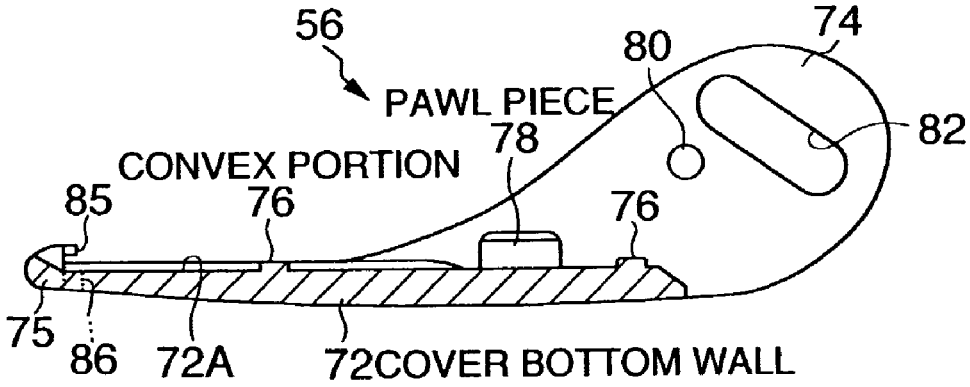
FIG. 27 is a sectional view of FIG. 26 take along the line D—D viewed from the direction of the arrows.

The figure of the cover 12 is not particularly limited. For example, as shown in FIG. 26 and FIG. 27, on the rear end of the front frame portion 75 in the front end area of the base cover 56, pawls 85 as holding sections of a height that forms a specific space between the upper face 72A of the cover bottom wall 72 may be formed so as to sandwich the front end of the base 21 of the stapler main body 11 between these pawls 85 and the forgoing upper face 72A to position the both sides in the direction of the width of the anvil 20. When the structure as described above is adopted, it becomes possible to hold the front and rear of the base 21 in combination with the aforementioned pawl pieces 78,78 that engage with the upper edge of the base side wall 47, particularly, it is made possible to effectively restrain the front end of the base 21 in the stapler main body 11 from being lifted up. Reference numeral 86 in FIG. 26 and FIG. 27 denotes a draft hole for molding process.

Further, such a structure may be adopted; i.e., the protrusion height of the convex portions 76 of the cover bottom wall 72 are adapted so as to protrude from the base bottom wall 46, and after the convex portions 76 are engaged with the holes 46A of the base bottom wall 46, the upper end of the convex portions 76 is melted therewith, or, the convex portions 76 are divided into two respectively and are reduced/increased in diameter thereof. In other words, the holding structure of the base 21 of the stapler main body 11 with respect to the base cover 56 is not limited to the example of the structure shown in figures, but various modifications of the design are possible.

Furthermore, the pressing section 61 of the upper cover 55 according to the embodiment may be structured by utilizing a part of the reinforcement ribs 60. In this case, for example, an example, in which the reinforcement rib at the rear end side is used as the pressing section 61, is given.

As described above, according to the present invention, because such a structure as describe below is adopted; i.e., the cover is provided so that the upper cover and the base cover are connected to be capable of performing relative rotation, and the stapler main body is mounted detachably to the cover; or, the stapler main body is mounted detachably to the cover without releasing the state of connection of the cover; or, the stapler main body is mounted detachably by rotating the same with respect to the cover in a state that the same is positioned between the upper cover and the base cover, since it is not necessary to mount the upper cover and the base cover separately to the handle and the base of the stapler main body, the cover can be mounted thereto extremely easily and swiftly. Further, since the upper cover and the base cover are connected and integrated with each other, even when the stapler is dropped on a floor or the like, it is possible to prevent the cover from being dismounted therefrom accidentally. Particularly, in such a structure that the mounting/dismounting of the stapler main body and the cover is made by a relative rotation thereof, it is possible to reliably prevent the stapler main body and the cover from being separated from each other unless an artificial operation is applied thereto.

Further, since a bearing groove capable of receiving the rotation shaft of the stapler main body is formed respectively in the rear-inside of the respective side walls of the upper cover, it is possible to position the rotation shaft of the stapler main body in the inner face side of the side walls not forcibly but smoothly; and owing to this, it is made possible to carry out the mounting work of the cover to the stapler main body easily and swiftly.

Furthermore, since the hooking sections are provided to the side wall to be capable of separating the front side of the handle forcibly from the front side of the frame, when the front end of the upper cover is rotated largely in the direction of separation with respect to the front end side of the base cover, a large space may be formed between the handle and the frame. Consequently, the loading operation of staples can be carried out easily.

Furthermore, in the such structure that the holding sections are formed on the base cover for engaging with the side edges of the base, it is made possible to hold the base so as not to become unstable in the direction of being lifted up with respect to the base cover.

Still further, when the convex portions on the the base cover is formed so as to engage with the face of the base, since it is possible to hold the base so as not to move in the direction of the face thereof and effects thereon in combination with the holding sections, it is possible to further stabilize the mounting position of the base.

Still furthermore, since a cam mechanism for displacing the upper cover to a recessed position with respect to the base cover is provided, even when the remover is extended from the rear end of the stapler main body, the upper cover can be operated to rotate without causing any positional interference between the upper wall rear end of the upper cover and the remover; therefore, since it is not necessary to form a large space in the rear area of the upper cover, it is possible to avoid such an inconvenience that the rear area of the upper cover becomes large undesirably.

Still further again, when such a structure that the upper cover and base cover are connected to each other to be capable of performing relative rotation at a point in front of the center of relative rotation of the stapler main body, and the upper cover is provided with a pressing section that gives a press-down force to the handle at a point in front of the center position of relative rotation of the upper cover and base cover is adopted, as it is possible to press the handle with a small operation force utilizing the upper cover effectively, even when the stapler is small in size, it is possible to use the same with relatively easy operation.

Still furthermore again, when such a structure that the front end of the upper cover is formed at a length so as to extend largely exceeding the front end of the handle, it is possible to achieve further reduction of the operation force.

What is claimed is:

1. A stapler, comprising:

a stapler main body including a frame being adapted to store at least one staple and having an ejecting section at a front end thereof, a handle provided with a pusher blade for driving out said staple from said ejecting section, and a base being mounted to be rotatable relative to the frame and the handle, and having an anvil for clinching said staple; and a cover mounted to said stapler main body so as to cover an outside of said stapler main body;

wherein said cover comprises an upper cover positioned at a handle side of said stapler main body, and a base cover positioned at a base side of said stapler main body, said base cover being rotatably connected with said upper cover;

said stapler main body is mounted detachably to said cover; and said upper cover includes:

an upper wall at an upper side of said handle;

a side wall contiguous to the upper wall; and a groove formed in a rear, inner side of said side wall for receiving a rotation shaft of said stapler main body.

2. The stapler according to claim 1, wherein said base cover has a holding section that engages with an outer edge of said base.

3. The stapler according to claim 1, wherein said base cover has a convex portion engaging with a face of said base.

4. The stapler according to claim 1, wherein said upper cover and said base cover are rotatable relative to each other about a first axis of rotation;

said handle and said base are rotatable relative to each other about a second axis of rotation; and said first axis is closer to said second axis than to said rusher blade;

said first axis is located forwardly of said second axis; and said upper cover has a pressing section for transferring an operation force to said handle, said pressing section being located forwardly of said first axis.

5. The stapler according to claim 4, wherein a front end of said upper cover extends beyond a front end of said handle.

6. The stapler according to claim 1, wherein said upper cover and said base covers are physically and directly attached to each other.

7. The stapler according to claim 1, wherein said upper cover and said base cover are rotatable relative to each other about a first axis of rotation;

said handle and said base are rotatable relative to each other about a second axis of rotation; and said first axis is closer to said second axis than to said pusher blade; and said second axis is closer to the first axis than to the ejecting section.

8. A stapler, comprising:

a stapler main body including a frame being adapted to store at least one staple and having an ejecting section at a front end thereof, a handle provided with a pusher blade for driving out said staple from said ejecting section, and a base being mounted to be rotatable relative to the frame and the handle, and having an anvil for clinching said staple; and a cover mounted to said stapler main body so as to cover an outside of said stapler main body;

wherein said cover comprises an upper cover positioned at a handle side of said stapler main body, and a base cover positioned at a base side of said stapler main body, said base cover being rotatably connected with said upper cover;

said stapler main body is mounted detachably to said cover; and said upper cover includes an upper wall at an upper side of said handle, and a side wall contiguous to the upper wall, said side wall having a hooking section for forcibly separating a front end side of the handle from a front end side of the frame.

9. A stapler, comprising:

a stapler main body including a frame being adapted to store at least one staple and having an ejecting section at a front end thereof, a handle provided with a pusher blade for driving out said staple from said ejecting section, and a base being mounted to be rotatable relative to the frame and the handle, and having an anvil for clinching said staple; and a cover mounted to said stapler main body so as to cover an outside of said stapler main body;

wherein said cover comprises an upper cover positioned at a handle side of said stapler main body, and a base cover positioned at a base side of said stapler main body, said base cover being rotatably connected with said upper cover;

said stapler main body is mounted detachably to said cover; and said stapler further comprises a cam mechanism between said upper cover and said base cover, said cam mechanism displacing said upper cover rearwardly with respect to the base cover when said covers are rotated away from each other.

10. The stapler according to claim 9, wherein said cam mechanism comprises a first protrusion formed in one of said upper and base covers; and a first elongated groove formed in the other of said upper and base covers;

wherein said first protrusion is rotatably retained in said first elongated groove and moveable along a length of said first elongated groove.

11. The stapler according to claim 10, wherein said one of said upper and base covers further comprises a second elongated groove;

the other of said upper and base covers further comprises a second protrusion received in and moveable along a length of said second elongated groove.

12. The stapler according to claim 11, wherein said stapler main body further comprises a rotational shaft about which said handle and said base are rotatable relative to each other; and one of said upper and base covers further includes a third elongated groove receiving said shaft therein, said shaft being moveable along a length of said third elongated groove.

13. The stapler according to claim 12, wherein said first elongated groove and said second protrusion are formed in an outer surface of a side wall of said upper cover;

said second elongated groove and said first protrusion are formed in an inner surface of a side wall of said base cover; and said third elongated groove is formed in an inner surface of the side wall of said upper cover.

14. A stapler, comprising:

a stapler main body including a frame being adapted to store at least one staple and having an ejecting section at a front end thereof, a handle provided with a pusher blade for driving out said staple from said ejecting section, and a base being mounted to be rotatable relative to the frame and the handle, and having an anvil for clinching said staple; and a cover mounted to said stapler main body so as to cover an outside of said stapler main body wherein said cover comprises an upper cover positioned at a handle side of said stapler main body, and a base cover positioned at a base side of said stapler main body, said base cover being rotatably connected with said upper cover;

said stapler main body is mounted detachably to said cover; and one of said upper and base covers includes a protrusion received in an elongated opening formed in the other of said upper and base covers;

said protrusion being rotatably retained by said opening and being moveable along a length of said elongated opening.

15. The stapler according to claim 14, wherein said stapler main body further comprises a rotational shaft about which said handle and said base are rotatable relative to each other, and one of said upper and base covers includes an elongated groove receiving said shaft therein, said shaft being moveable along a length of said elongated groove.

16. The stapler according to claim 15, wherein said length includes a curved section and a straight section contiguous to said curved section.

17. A stapler, comprising:

a stapler main body including a frame being adapted to store at least one staple and having an ejecting section at a front end thereof;

a handle provided with a pusher blade for driving out said staple from said ejecting section, and a base being mounted to be rotatable relative to the frame and the handle, and having an anvil for clinching said staple; and a cover mounted to said stapler main body so as to cover an outside of said stapler main body;

wherein said cover comprises an upper cover positioned at a handle side of said stapler main body, and a base cover positioned at a base side of said stapler main body, said base cover being rotatably connected with said upper cover;

said stapler main body is mounted detachably to said cover;

said stapler main body further comprises a rotational shaft about which said handle and said base are rotatable relative to each other; and one of said upper and base covers includes an elongated groove receiving said shaft therein, said shaft being moveable along a length of said elongated groove.

18. The stapler according to claim 17, wherein said groove has an open end through which said shaft is inserted into said groove, and a dead end, said length being defined between said open and dead ends.

19. The stapler according to claim 17, wherein said length includes at least a curved section.

20. The stapler according to claim 19, wherein said length further includes a straight section contiguous to said curved section.

* * * * *